United States Patent [19]

Bisaiji

[11] Patent Number: 4,837,597

[45] Date of Patent: Jun. 6, 1989

[54] METHOD AND APPARATUS APPLICABLE TO MULTICOLOR DEVELOPING DEVICE FOR DETECTING IMAGE DENSITY

[75] Inventor: Takashi Bisaiji, Yokohama, Japan

[73] Assignee: Ricoh Company, Ltd., Tokyo, Japan

[21] Appl. No.: 168,235

[22] Filed: Mar. 15, 1988

[30] Foreign Application Priority Data

Mar. 19, 1987 [JP] Japan ..... 62-64595

[51] Int. Cl.[4] ..... G03G 21/00

[52] U.S. Cl. ..... 355/203; 118/689; 118/691; 250/338.1; 250/341; 355/14 D

[58] Field of Search ..... 355/3 DD, 4, 14 D; 118/688, 689, 691; 250/338.1, 341; 356/243, 443, 444

[56] References Cited

U.S. PATENT DOCUMENTS

| | | | |
|---|---|---|---|
| 3,376,426 | 4/1968 | Frommer et al. | 250/341 X |
| 3,623,818 | 11/1971 | Gardner et al. | 250/341 X |
| 4,550,998 | 11/1985 | Nishikawa | 355/3 DD |
| 4,644,163 | 2/1987 | Selander | 250/341 |
| 4,742,228 | 5/1988 | Bischoff | 250/341 |
| 4,750,838 | 6/1988 | DeWolf et al. | 356/444 X |

FOREIGN PATENT DOCUMENTS

| | | | |
|---|---|---|---|
| 2557129 | 6/1977 | Fed. Rep. of Germany | 250/341 |
| 60-115820 | 6/1985 | Japan | 250/341 |

*Primary Examiner*—Fred L. Braun

*Attorney, Agent, or Firm*—Oblon, Spivak, McClelland, Maier & Neustadt

[57] ABSTRACT

A light absorbing body is located to adjoin the back of an image carrier which is made of a light transmitting member. A latent image representative of an exclusive pattern for density detection is formed in a non-image region of the image carrier and developed by toner of any of multiple colors to become a toner image adapted for density detection. The toner image is illuminated so that image density is detected in terms of the intensity of light which is reflected by the toner image. The light absorbing body is made up of a plurality of absorbing members each having predetermined absorptivity. The absorbing members are selectively used in association with the spectral reflectivity characteristic of toner.

13 Claims, 7 Drawing Sheets

METHOD AND APPARATUS APPLICABLE TO MULTICOLOR DEVELOPING DEVICE FOR DETECTING IMAGE DENSITY

BACKGROUND OF THE INVENTION

The present invention relates to a method and an apparatus applicable to a multicolor developing device for detecting the density of an image. More particularly, the present invention is concerned with a method and an apparatus applicable to a multicolor developing device for forming in a non-image region of an image carrier a latent image which is representative of an exclusive pattern for density detection, then developing the latent image by toner of any of multiple colors, and then illuminating the resulting toner image to detect image density in terms of the amount of reflection.

Generally, a multicolor developing device installed in an electrophotographic copier or similar color image recorder is provided with an implementation for detecting image density on the basis of which image forming conditions are controlled. Such an implementation uses, for example, a latent image representative of an exclusive pattern for density detection and formed in a non-image region of a photoconductive drum or like image carrier. The latent image is developed by toner of any of multiple colors to become a toner image. This toner image of particular color is illuminated by light so that image density associated with that color is measured in terms of the intensity of light reflected by the toner image. In this kind of implementation, the image carrier has a face member which is constituted by a light transmitting member while a light absorbing member is located at the back of the image carrier, so that light incident to that part of the image carrier where toner is not deposited is transmitted through the image carrier to be absorbed by the light absorbing member.

Although the spectral reflectivity distribution differs from toner of one color to toner of another color, all the toner of various colors show reflectivety of substantially 100% in the infrared range. In the light of this, the light adapted for detection is often implemented by infrared light to accomplish a good reflectivity characteristic with no regard to the color of toner. A current rend in the imaging art is toward furnishing a full-color developing device which uses cyan toner, magenta toner and yellow toner or a multicolor developing device which uses red toner, blue toner and green toner with a black-and-white reproduction capability which uses black toner independently of the others. With such a type of full-color or a multicolor developing device, it is impossible to achieve high detection sensitivity because the reflectivity of black toner is low (substantially zero) even in the infrared range and, therefore, a sufficient amount of reflection is unattainable despite the use of infrared light for the detection.

SUMMARY OF THE INVENTION

It is, therefore, an object of the present invention to provide a method and an apparatus capable of detecting the density of an image with high sensitivity with no regard to the color of toner.

In accordance with the present invention, a method of detecting the density of an image which is developed in multiple colors comprises the steps of preparing an image carrier constituted by a light transmitting member for carrying a latent image thereon, positioning a light absorbing body having a predetermined light absorption characteristic and constituted by a plurality of absorbing members, in contact with the back of the image carrier, forming in a non-image region of the image carrier a latent image which is representative of an exclusive pattern for density detection, developing the latent image by toner of any of the multiple colors to produce a toner image adapted for density detection, illuminating the toner image by light from the face side of the image carrier, and determining an amount of toner in terms of intensity of light which is reflected by the toner image and, thereby, detecting image density.

In accordance with the present invention, an apparatus for detecting the density of an image which is developed in multiple colors comprises an image carrier in a non-image region of which a latent image representative of an exlusive pattern for density detection is formed and developed by toner of any of the multiple colors to become a toner image for density detection, a photosensor located above the face of the image carrier for emitting light toward the toner image and sensing light reflected by the toner image, a light absorbing body located below and in contact with the back of the image carrier and constituted by a plurality of absorbing members each having a predetermined absorption characteristic, drive means for driving the light absorbing body to selectively move the absorbing members to a position to which the light is to become incident, and control means for controlling the drive means such that one of the absorbing members which is associated with a spectral reflectivity characteristic of the color of the toner image is moved to the position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
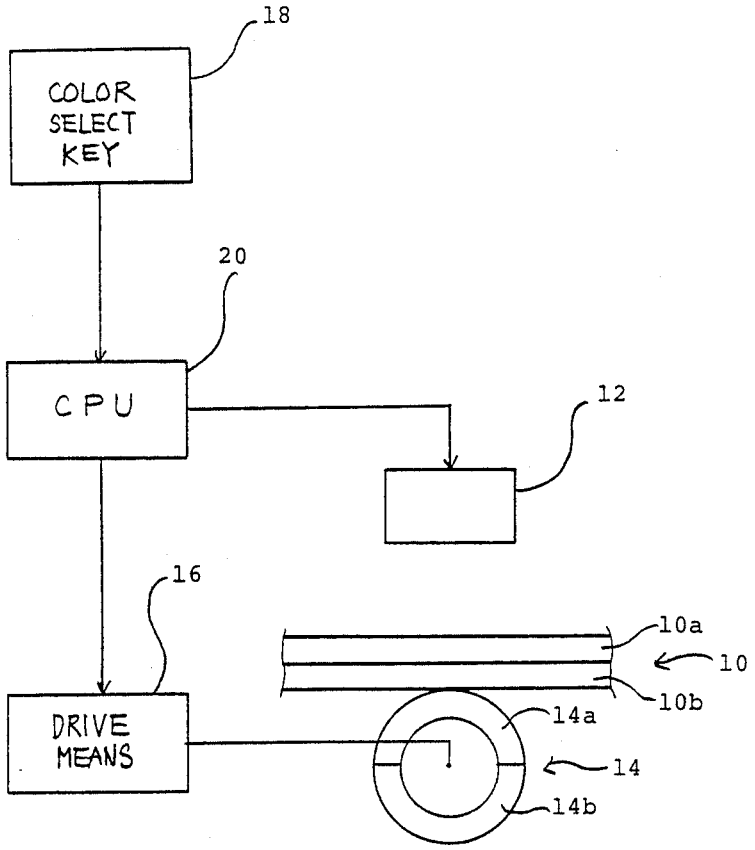
FIG. 1 is a schematic view showing an arrangement for the detection of image density which is representative of one embodiment of the present invention.

Referring to FIG. 1 of the drawings, a photoconductive element 10 which serves as an image carrier has a face and a back, i.e., an upper and lower surface as viewed in the figure. While a photosensor 12 is located in the vicinity of and at a predetermined distance from the upper surface of the photoconductive element 10, a light absorbing body 14 is positioned below and in contact with the lower surface of the element 10. The photoconductive element 10 is made up of a photosensitive layer 10*a* and a conductive layer 1*b* which are laminated together. The photosensitive layer 10*a* overlies the photoconductive layer 1*b* and is implemented with a light transmitting member. The photosensor 12 is constituted by a light emitting diode (LED) or like light emitting element having a luminescense distribution in the infrared range, and a light sensitive element responsive to light which is emitted from the light emitting element and then reflected. Comprising a hollow cylindrical drum, the light absorbing body 14 is driven in a rotary motion in contact with the photoconductive element 10 by drive means 16 which is associated with the body 14, and it can be held in a halt at a predetermined position. As shown, the light absorbing body 14 is made up of two absorbing halves joined together and each having a semicircular cross-section, i.e., an absorbing member 14*a* assigned to color toner and an absorbing member 14*b* assigned to black toner. The absorbing member 14*a* may be implemented with a black member whose absorptivity is substantially 100%, and the absorbing member 14*b* may be implemented with a metal member whose absorptivity is substantially 0% such as a member made of aluminum.

An operation board, not shown, is provided with a key 18 which is operable to select a color to reproduce, i.e., a color to control. A color selection signal from the key 18 is applied to a central processing unit (CPU) 20. The photosensor 12 and the drive means 16 are individually driven by a command from the CPU 20, so that they are preconditioned in association with a particular color selected before detecting the density of an image. Specifically, prior to the emission of light from the photosensor 12, the drive means 16 is operated to rotate the light absorbing body 14 such that, when the color selected is other than black, the absorbing member 14*a* makes contact with the photoconductive element 10 and, when it is black, the absorbing member 14makes contact with the photoconductive element 10.

Figure 2:
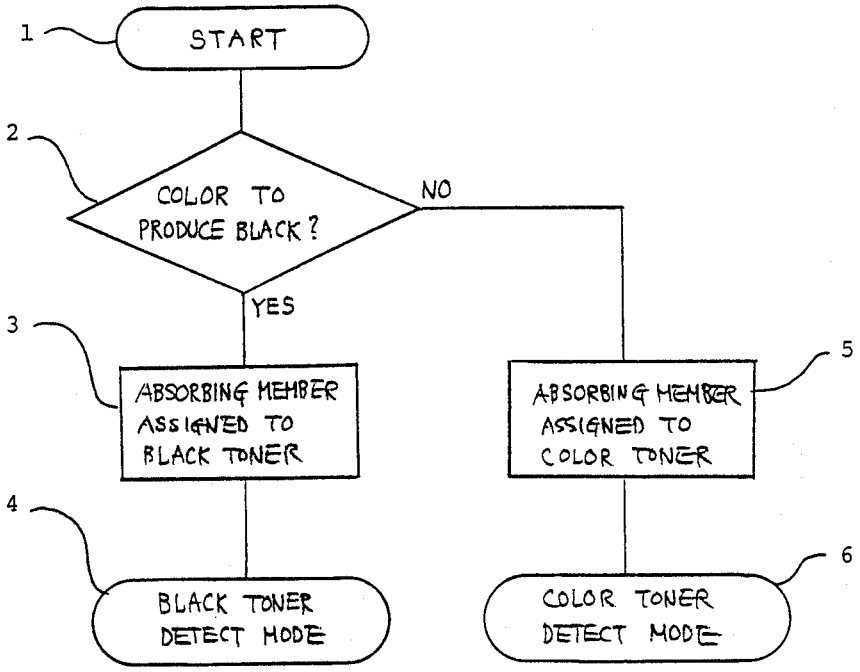
FIG. 2 is a flowchart demonstrating a detection procedure executed by the arrangement of FIG. 1.

FIG. 2 is a flowchart demonstrating the operation of the embodiment which is constructed as described with reference to FIG. 1. When the key 18 on the operation board is operated to start an image density detecting procedure (step 1), the CPU 20 determines whether or not the color to reproduce or control is black in response to a color selection signal from the key 18 (step 2). Then, the CPU 20 delivers to the photosensor 12 a command which is associated with a particular color determined, whereby the photosensor 12 emits light to effect the detection of image density. Prior to the emission of light from the photosensor 12, the CPU 20 feeds a command to the drive means 16 so that a preparatory operation matching with the color selected is completed. In detail, when the color selected is black as decided in the step 2, the drive means 16 is actuated before the activation of the photosensor 12 so as to bring the absorbing member 14*b* of the light absorbing body 14 into contact with the photoconductive element 10 (step 3). Thereupon, a black toner detection mode is executed (step 4). Conversely, when the color selected is other than black as decided in the step 2, the drive means 16 rotates the member 14 such that the absorbing member 14a makes contact with the photoconductive element 10 (step 5). This is followed by a color toner detection mode as distinguished from the black toner detection mode (step 6).

Figure 3A:
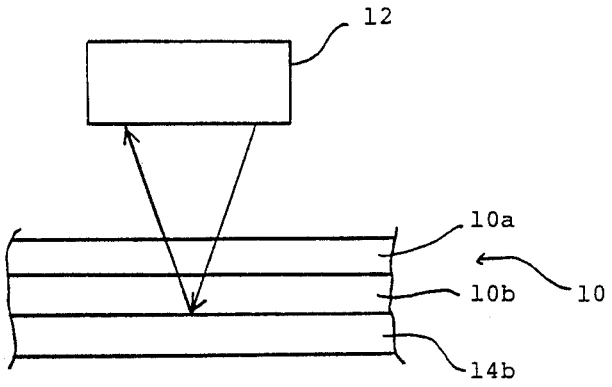
FIGS. 3A and 3B are schematic enlarged views showing a black toner detection mode.
Figure 3B:
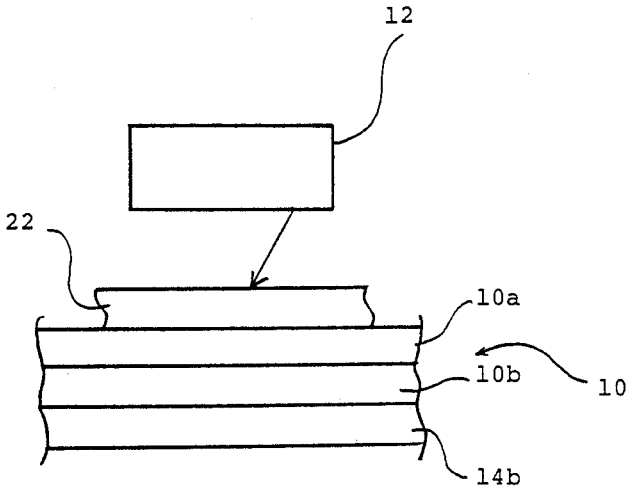
Figure 5:
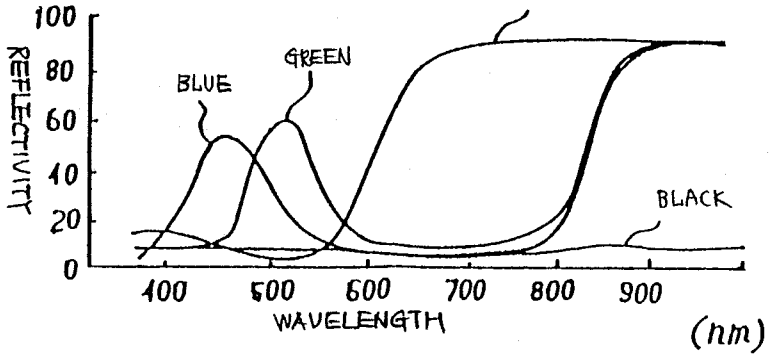
FIG. 5 is a plot showing reflectivity distributions of toner of different colors with respect to a wavelength.

What occurs in the black toner detection mode is shown in FIGS. 3A and 3B. As shown in FIG. 3A, when a toner image is not present on the photoconductive element 10, light issuing from the photosensor 12 (infrared light) is transmitted through the photoconductive element 10 to reach the absorbing member 14*b* to be reflected thereby. Since the reflectivity of the absorbing member 14*b* is substantially b 100%, it reflects a substantially 100% of the light which is incident thereto. The light reflected by the absorbing member 14*b* is transmitted again through the photoconductive element 10 to become incident to the light sensitive element of the photosensor 12. The resulting output of the light sensitive element is representative of the absence of a toner image on the photoconductive element 10. On the other hand, when a toner image 22 produced by a sufficient amount of black toner is present on the photoconductive element 10, the light issuing from the photosensor 12 (infrared light) is almost entirely absorbed by the toner image 22, as shown in FIG. 3B. This is because the reflectivity of black toner is substantially 0% even for infrared light, as shown in FIG. 5. This time, the light sensitive element of the photosensor 12 receives hardly any light and therefore produces an output which is almost zero, indicating that a sufficient amount of toner is present on the photoconductive element 10. If the amount of black toner which forms the toner image 22 is not sufficient, the output of the light sensitive element is representative of a condition intermediate between the above-described two extreme conditions. Then, a signal proportional to the amount of toner is produced and, hence, the amount of toner is measured.

Figure 4A:
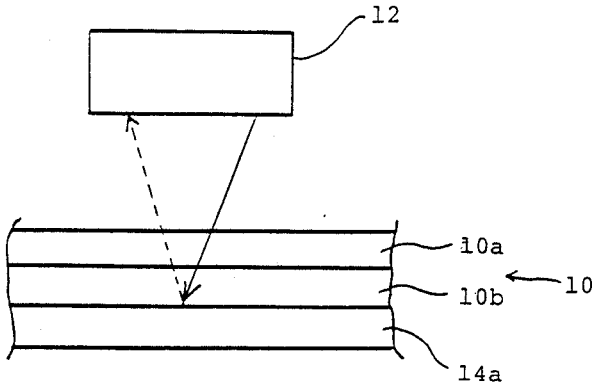
FIGS. 4A and 4B are views similar to FIGS. 3A and 3B, showing a color toner detection mode.
Figure 4B:
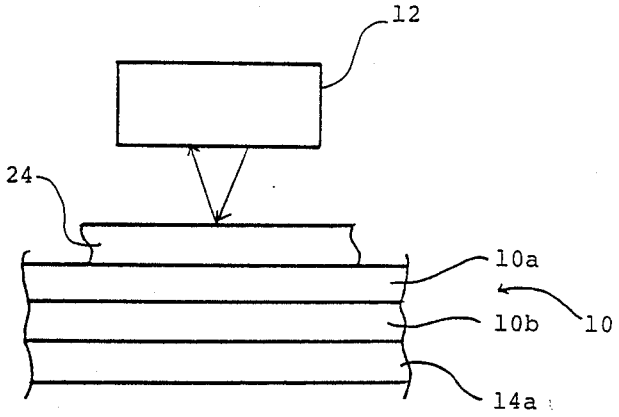

FIGS. 4A and 4B show two different conditions which may be encountered in the color toner detection mode. As shown in FIG. 4A, when a toner image is not present on the photoconductive element 10, light emitted from the photosensot 12 (infrared light) is transmitted through the element 10 to reach the absorbing member 14*a* of the light absorbing body 14. A substantially 100% of the light incident to the absorbing member 14*a* is absorbed because the reflectivity of the member 14*a* is substantially 0%. As a result, substantially no light is incident to the light sensitive element of the photosensor 12 and, hence, the output of the light sensitive element is almost zero indicating that toner is absent. When a toner image 24 formed by a sufficient amount of color toner is present on the photoconductive element 10, the light issuing from the photosensor 12 is substantially entirely reflected by the toner image 24, as shown in FIG. 4B. This is because the reflectivity of color toner is substantially 100% for infrared rays, as shown in FIG. 5. The light reflected by the toner image 24 is again incident to the photosensor 12 to be received by the light sensitive element. In this condition, the output of the light sensitive element is representative of the presence of a sufficient amount of color toner on the photoconductive element 10. Further, when the amount of color toner is not sufficient, the light sensitive element of the photosensor 12 produces an intermediate output as in the black toner detection mode. Consequently, a signal proportional to the amount of color toner is produced to allow the amount of toner to be measured.

Figure 6:
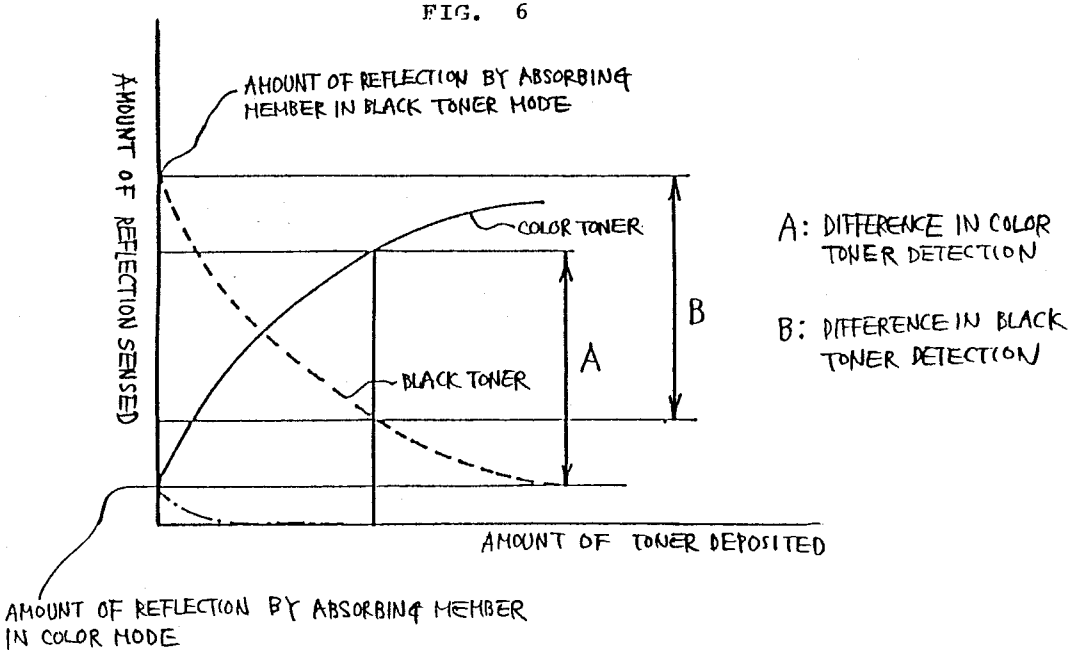
FIG. 6 is a plot showing a relationship between the amount of toner deposited and the amount of light reflected for each of black toner and toner of other colors.

Although the black toner and the color toner are measured in an opposite relation to each other with respect to the values of light intensity, high detection sensitivity is achievable with both of them. FIG. 6 shows an exemplary relationship between the amount of toner deposited on the photoconductive element 10 (coordinate) and the amount of reflection sensed (abscissa) as determined with each of color toner and black toner. As shown, the solid curve and the dashed curve which are respectively associated with color toner and black toner are substantially symmetrical to each other. Nevertheless, the detection sensitivity is high for each of the color toner and black toner as represented by A and B, respectively.

Figure 7:
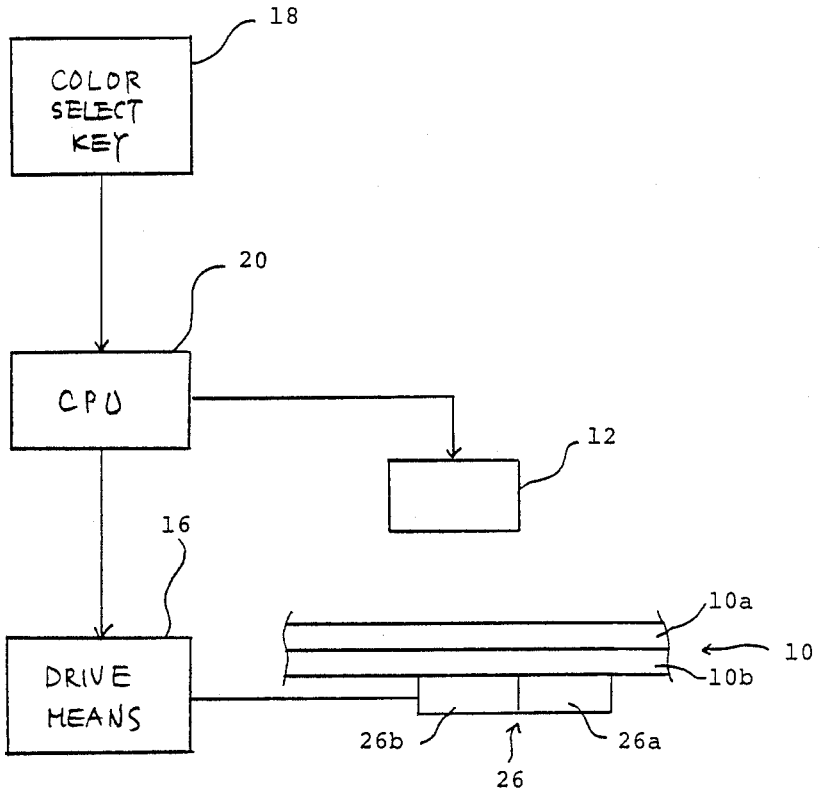
FIG. 7 is a schematic view showing another embodiment of the present invention.

Referring to FIG. 7, another embodiment of the present invention is shown. In the figure, the same or similar structural elements as those shown in FIG. 1 are designated by like reference numerals. In this particular embodiment, a light absorbing body 26 is implemented with a flat member and made up of an absorbing member 26a assigned to color toner and an absorbing member assigned to black toner which are juxtaposed along the photoconductive element 10. The light absorbing body 26 is driven by the drive means 16 in a reciprocating motion to replaced each other in matching relation to the detection mode selected.

In summary, it will be seen that the present invention allows a single sensor to exhibit high sensitivity with no regard to the color of toner and therefore guarantees stable control to produce desirable images. This advantage is derived from a unique arrangement in which members adapted for the absorption of light are selectively used depending upon the color to control, i.e., light for detection is adequately reflected all the time.

Various modifications will become possible for those skilled in the art after receiving the teachings of the present disclosure without departing from the scope thereof.

What is claimed is:

1. A method of detecting the density of an image which is developed in multiple colors, comprising the steps of:

(a) preparing an image carrier constituted by a light transmitting member for carrying a latent image thereon;

(b) positioning a light absorbing body having a predetermined light absorption characteristic and constituted by a plurality of absorbing members, in contact with a back of said image carrier;

(c) forming in a non-image region of said image carrier a latent image which is representative of an exclusive pattern for density detection;

(d) developing said latent image by toner of any of said multiple colors to produce a toner image adapted for density detection;

(e) illuminating said toner image by light from a face side of said image carrier; and (f) determining an amount of toner in terms of intensity of light which is reflected by said toner image and, thereby, detecting image density.

2. A method as claimed in claim 1, further comprising g) selecting one of said absorbing members of said light absorbing body which is associated with a spectral reflectivity characteristic of the toner of said toner image.

3. A method as claimed in claim 2, wherein said absorbing members of said light absorbing body comprise an absorbing member assigned to color toner and an absorbing member assigned to black toner.

4. A method as claimed in claim 3, wherein said absorbing member assigned to color toner comprises a black member having absorptivity of 100%, and said absorbing member assigned to black toner comprises a metal member having absorptivity of 0%.

5. A method as claimed in claim 1, wherein said light for detection is infrared light.

6. An apparatus for detecting the density of an image which is developed in multiple colors, comprising:

an image carrier in a non-image region of which a latent image representative of an exclusive pattern for density detection is formed and developed by toner of any of said multiple colors to become a toner image for density detection;

a photosensor located above a face of said image carrier for emitting light toward said toner image and sensing light reflected by said toner image;

a light absorbing body located below and in contact with a back of said image carrier and constituted by a plurality of absorbing members each having a predetermined absorption characteristic;

drive means for driving said light absorbing body to selectively move said absorbing members to a position to which said light is to become incident; and control means for controlling said drive means such that one of said absorbing members which is associated with a spectral reflectivity characteristic of the color of said toner image is moved to said position.

7. An apparatus as claimed in claim 6, wherein said image carrier comprises a photosensitive layer adjacent to said face and a conductive layer adjacent to said back and provided on said photosensitive layer.

8. An apparatus as claimed in claim 6, wherein said light is infrared light.

9. An apparatus as claimed in claim 6, wherein said absorbing members of said light absorbing body comprise an absorbing member assigned to color toner and an absorbing member assigned to black toner.

10. An apparatus as claimed in claim 9, wherein said absorbing member associated with color toner comprises a black member whose absorptivity is 100%, and said absorbing member associated with black toner comprises a metal member whose absorptivity is 0%.

11. An apparatus as claimed in claim 6, wherein said photosensor comprises a light emitting element for emitting said light and a light sensitive element for receiving said reflected light.

12. An apparatus as claimed in claim 6, wherein said light absorbing body comprises a hollow cylindrical drum which is driven by said drive means in a rotary motion.

13. An apparatus as claimed in claim 6, wherein said light absorbing body comprises a flat body which is driven by said drive means in a reciprocating motion.

* * * * *